US005164059A

United States Patent [19]

Geiermann et al.

[11] Patent Number: 5,164,059

[45] Date of Patent: Nov. 17, 1992

[54] ELECTROPLATING APPARATUS WITH IMPROVED CURRENT COLLECTOR

[75] Inventors: Thomas J. Geiermann, Bangor Township, Bay County; Kenneth A. Schmidt, Bay City, both of Mich.

[73] Assignee: Newcor, Inc., Troy, Mich.

[21] Appl. No.: 768,463

[22] Filed: Sep. 27, 1991

Related U.S. Application Data

[63] Continuation of Ser. No. 667,529, Mar. 11, 1991.

[51] Int. Cl.[5] ..... C25D 17/00; C25D 17/10

[52] U.S. Cl. ..... 204/206; 204/279

[58] Field of Search ..... 204/206, 279, 280

[56] References Cited

U.S. PATENT DOCUMENTS

| | | | |
|---|---|---|---|
| 3,176,254 | 3/1965 | Fisher | 439/28 |
| 3,839,606 | 10/1974 | Paradine | 204/279 |
| 3,910,833 | 10/1975 | Knighton | 204/279 |

*Primary Examiner*—T. M. Tufariello

*Attorney, Agent, or Firm*—Flynn, Thiel, Boutell & Tanis

[57] ABSTRACT

An electroplating apparatus having a tank containing a bath of an electrolytic solution, and a roll supported for immersion into the electrolytic bath for transporting a sheet material through the bath. The roll has a current collector rotatably supported on a shaft thereof for transmitting high amperage electricity to the roll. The current collector is supported on a part of the shaft which projects exteriorly of the tank side wall, and incorporates a sleevelike housing structure which surrounds and is rotatable relative to the shaft and mounts therein a plurality of conductive shoes which are of a highly electrically conductive material and are spring urged for snug radial contact with a conductive ring secured to a conductive sleeve arrangement which snugly axially and nonrotatably mounts to the shaft. The housing cooperates with the sleeve arrangement to define a generally sealed interior annular chamber in which the current-conducting shoes are positioned. A pressurized lubricating system is connected to the current collector for permitting substantially continuous supply of lubricant through the chamber.

13 Claims, 5 Drawing Sheets

ELECTROPLATING APPARATUS WITH IMPROVED CURRENT COLLECTOR

This application is a continuation of U.S. Ser. No. 07/667,529 filed Mar. 11, 1991.

FIELD OF THE INVENTION

This invention relates to an electroplating apparatus, such as for galvanizing sheet steel, and particularly to such apparatus having an improved current collector associated with a plating roll.

BACKGROUND OF THE INVENTION

When electroplating sheet material, and specifically galvanizing thin sheet steel, one conventional plating arrangement utilizes a tank containing a bath of plating solution, and several large-diameter rolls are supported on the tank so that lower portions of the rolls are immersed in the tank. The sheet material is engaged with and wrapped around the lower portions of the rolls so as to progressively move through the electroplating bath in response to roll rotation. The roll is provided with a current-conducting member extending generally around the periphery thereof for contact with the sheet material so that this member and the sheet effectively function as a cathode, and the lower periphery of the roll as immersed in the bath is also disposed closely adjacent but slightly spaced from an arcuate anode which is fixed relative to the tank, whereby the sheet material passes closely adjacent the anode as it is wrapped around the lower portion of the roll. Electrical current of high amperage is applied to a shaft which is fixed to and rotates with the roll, and for this purpose it is conventional to provide a current collector which is mounted on the shaft exteriorly of but adjacent the tank. This current collector, which has been in use on electroplating apparatus for many years, includes a collector rotor which is secured to a tapered end of the roll shaft which projects outwardly from the tank, and this collector rotor is surrounded by an enlarged and substantially hollow stationary housing. This housing mounts therein an extremely large number (for example 60) of conventional current-transfer brushes or contacts which are disposed in slidable contact with the rotating rotor. These brushes are individually coupled to current-transfer cables which project to an exterior source of direct current. The anode associated with the rotor is also coupled to the source of direct current. With this known arrangement, which has been conventionally industrially used for many years, the electrical potential from the roll cathode and the radially adjacent anode coact with the electrolytic solution in a conventional manner to permit deposit of plating material on the sheet material. While this known apparatus and technique have been utilized for many years, the supply of high amperage current to the rotatable roll has long presented a significant problem due to the hostile and corrosive environment created by the electrolytic solution in the tank, and the high amperage required to successfully perform the process. Due to the rotation of the roll relative to the tank, the conventional current collector used for transferring electric current to the roll shaft have presented an ongoing maintenance problem both due to wear and due to deterioration caused by the corrosive environment. Maintaining, replacing and/or rebuilding the current collector has thus been a common occurrence which has created an excessive amount of undesirable maintenance and an excessively undesirable amount of shut down time of the apparatus. More specifically, this conventional current collector inherently results in excessive brush wear and, due to the voltage which is necessarily required by the electroplating operation, results in an undesirable amount of power loss (i.e., voltage drop). The high current and the inefficient current transfer associated with the large number of current-conducting brushes also result in excessive heat generation, and this can be combatted only by flooding the interior of the housing in surrounding relationship to the brushes with water. This known and long utilized current collector has exhibited less than desirable performance characteristics, but has nevertheless been continually used due to lack of a better alternative.

In another conventional plating arrangement, there is again provided a tank containing a bath of plating solution, and having several large-diameter rolls supported thereon so that the rolls are immersed in the solution. In this arrangement, however, there are provided vertically-opposed pairs of rollers disposed in generally horizontally aligned relationship, with the vertically opposed pairs defining a nip therebetween which is disposed in the plating bath. The sheet material is then fed generally horizontally into the nip of one pair of rollers, and then fed tautly generally horizontally through the bath to the nip associated with the next pair of rollers. Electrical potential is supplied to the rollers which, due to their contact with the sheet material, effectively function as a cathode. An anode formed as a generally horizontally enlarged plate is stationarily positioned in the bath so as to extend generally between adjacent lower rolls in close proximity to the sheet which extends tautly between the nips of adjacent roll pair. With this arrangement, current collector devices are again coupled to the shafts of the rolls for transmitting electrical energy thereto, which current collectors may again be of the type described above, or in the alternative may be of the type employing a plurality of cables which wrap around the roll shaft to permit current transfer thereto. This latter type of current collector also possesses obvious disadvantages in that it is inefficient and results in undesirable voltage drop or loss.

It is thus an object of this invention to provide an improved current collector for permitting transfer of high amperage current to the shaft of a rotatable electroplating roll, which arrangement is believed to provide significantly improved performance and thus overcome many of the known problems associated with prior electroplating systems.

More specifically, this invention relates to an electroplating apparatus, namely an apparatus having a tank containing a bath of an electrolytic solution, and a roll supported for immersion into the electrolytic bath for transporting a sheet material through the bath, with the roll having a current collector rotatably supported on a shaft thereof for transmitting high amperage electricity to the roll. The improved current collector of this invention is supported on a part of the roll shaft which projects exteriorly of the tank side wall. The current collector incorporates a sleeve-like housing structure which surrounds and is rotatable relative to the shaft and mounts therein a small number of conductive shoes which are of a highly electrically conductive material and are spring urged for snug radial contact with a conductive ring secured to a conductive sleeve arrangement which snugly axially and nonrotatably mounts to the roll shaft.

In the improved arrangement of this invention, as aforesaid, the nonrotatable housing of the current collector cooperates with the sleeve arrangement to define a generally sealed interior annular chamber in which the current-conducting shoes are positioned. A closed-loop pressurized lubricant system is connected to the current collector for permitting a substantially continuous supply of lubricant into the chamber and withdrawal of lubricant therefrom to provide for both substantial lubrication and cooling to permit transmission of high amperage electric current through the shoes to the conductive ring and thence therethrough to the shaft. This arrangement isolates the critical relatively-rotatable current transferring contact surfaces from the hostile environment and additionally provides for proper lubrication and cooling thereof to achieve relatively long and maintenance free operation. This arrangement also greatly reduces power loss (i.e., voltage drop) to provide significantly more efficient transfer of electrical potential to the roll.

Other objects and purposes of the present invention will be apparent to persons familiar with arrangements of this general type upon reading the following specification and inspecting the accompanying drawings.

Figure 1:
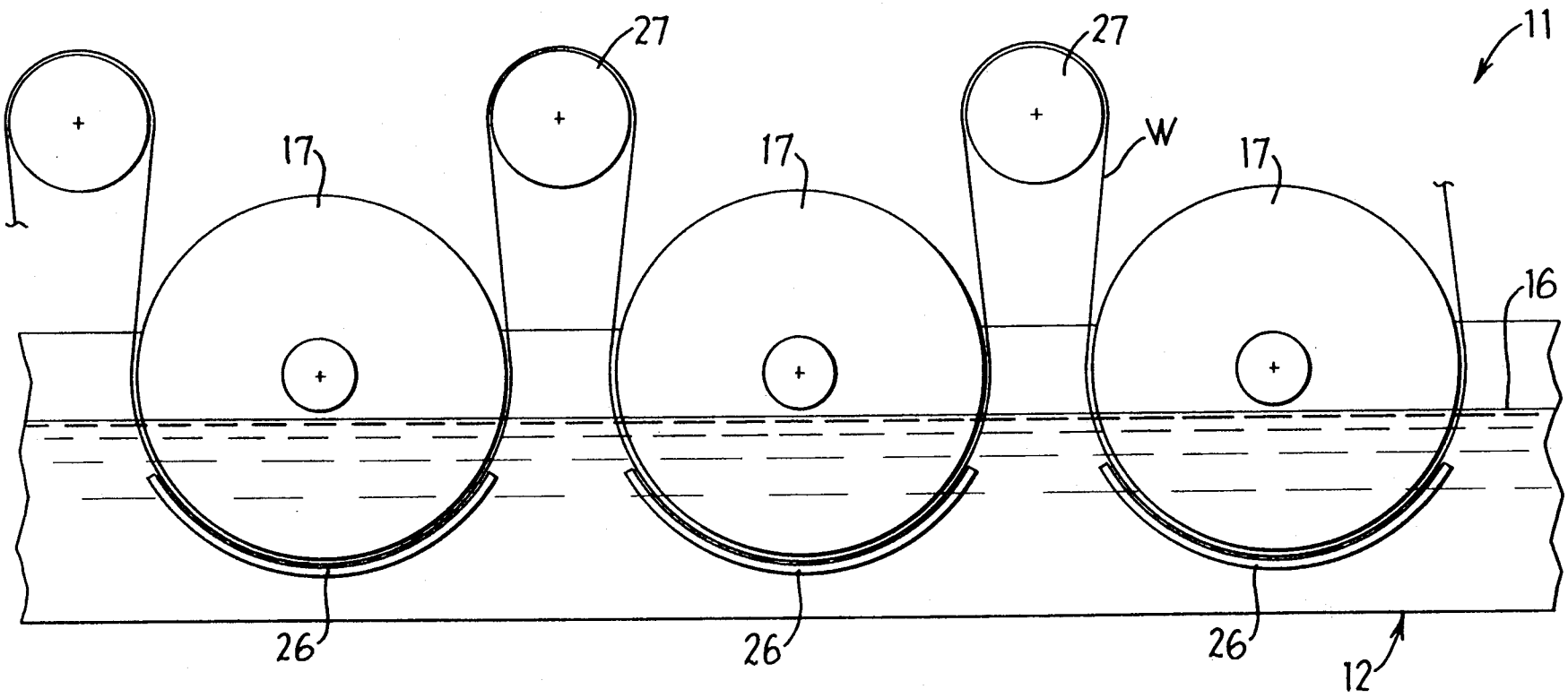
FIG. 1 is a fragmentary and diagrammatic elevational view of the overall arrangement of a typical electroplating apparatus for plating sheet metal, such as for galvanizing sheet steel.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward or away from, respectively, the geometric center of the apparatus or designated parts thereof. Said terminology will include the words specifically mentioned, derivatives thereof, and words of similar import.

DETAILED DESCRIPTION

Figure 2:
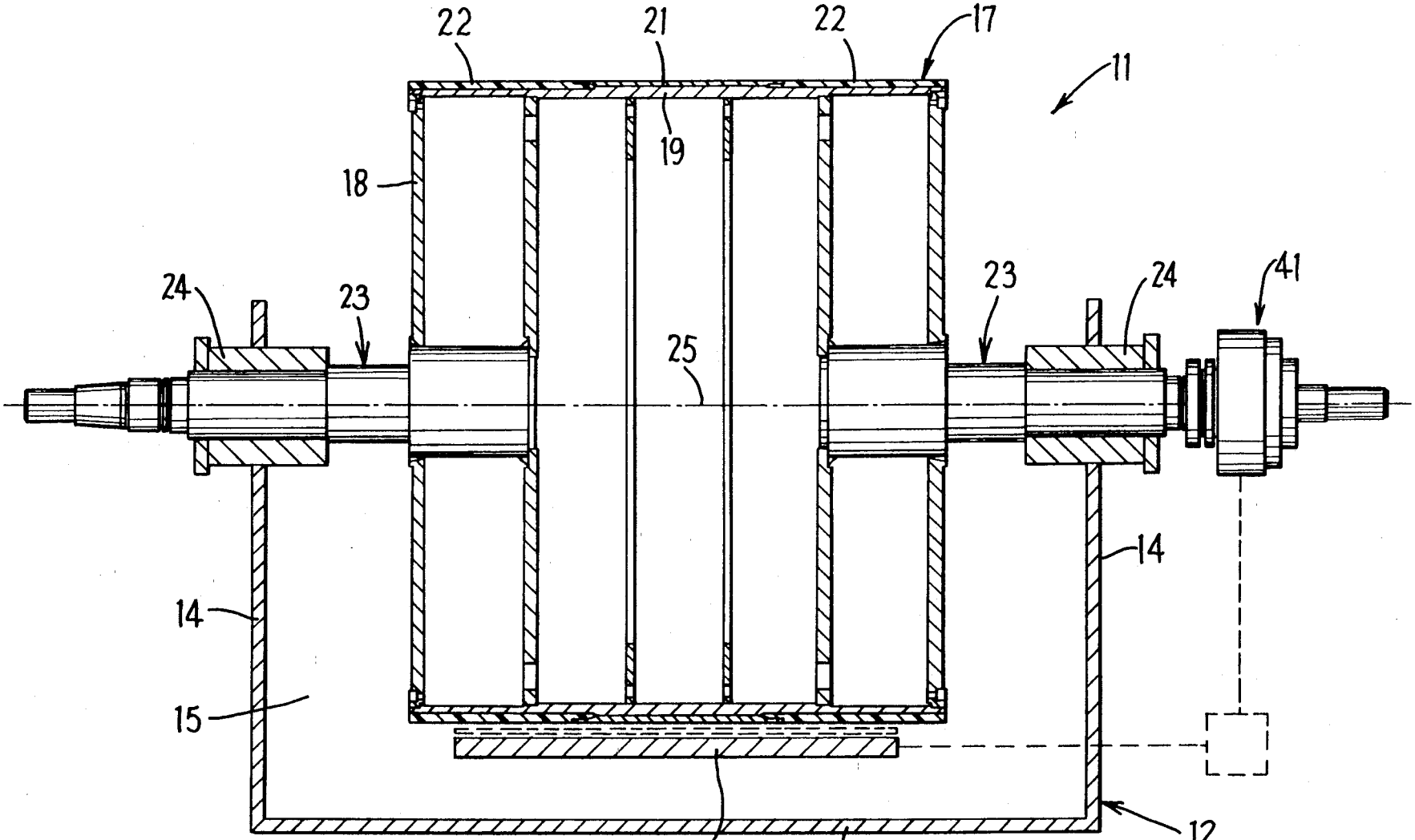
FIG. 2 is an enlarged vertical sectional view substantially through the vertical axial plane of one of the rolls.

Referring to FIGS. 1 and 2, there is illustrated an electroplating arrangement 11 which includes a generally upwardly opening tank 12 having a bottom wall 13 and a pair of upwardly projecting side walls 14 for defining therein an interior chamber 15 which contains an electrolytic bath 16. The tank typically supports a plurality of large-diameter plating rolls 17 in sidewardly-spaced relationship therealong, which rolls are rotatably supported in generally parallel relationship and disposed so that the lower portion of the roll is immersed in the electrolytic bath 16. The roll 17 is formed substantially as a large-diameter closed drum 18 having a substantially cylindrical peripheral wall 19. This peripheral 19 in turn has an annular electrically-conductive element 21 secured therearound. This conductive element 21, on axially opposite sides thereof, is normally bounded by annular insulators 22 so as to provide a substantially uniform exterior peripheral surface.

The roll 17 has a shaft structure coaxially fixedly secured to the drum 18, which shaft structure typically includes a pair of stepped cantilevered shaft portions 23 which are fixed to and project coaxially outwardly from opposite ends of the drum 18. These shaft portions 23 project outwardly through the respectively adjacent tank side walls 14, and are suitably rotatably supported by appropriate bearing units 24 so as to permit the entire roll 17 to be rotatable about the central axis 25.

The roll 17 is rotatably driven from a conventional motor (not shown) which is disposed exteriorly of the tank and is interconnected to one of the projecting ends of the shaft portions 23.

The electrolytic bath 16 in the tank is normally maintained at an elevation slightly below the shaft 23 so that a majority of the lower half of the roll 17 is immersed in the bath.

The arrangement 11 also typically employs a plurality of guide or support rolls 27 which are positioned upwardly above the rolls 17 to facilitate the feeding of a sheet material, designated W, into and out of the bath, and from roll-to-roll as the workpiece W progressively moves through the bath.

Each of the rolls 17 also has a further conductive member 26, functioning as an anode, disposed in close association to the lower periphery thereof. The anode 26 is stationarily secured relative to the tank and is of an arcuate configuration so as to extend along a substantial portion of the immersed periphery of the respective roll 17, with this anode 26 being disposed closely radially adjacent but spaced a small radial distance from the roll cathode 21 to permit the workpiece W to be disposed in the narrow gap defined between the cathode 21 and the anode 26.

The electroplating arrangement 11 described above is traditionally provided with a current transfer device which is disposed outside the tank and coupled to one of the shaft portions 23, with such device employing a plurality of carbon brushes which are maintained in current-transfer slidable contact with the periphery of a sleeve mounted on the shaft. This current transfer device is generally coupled to conductive cables and, along with further cables which couple to the anode, are coupled to an exterior high-amperage potential source. Such electroplating arrangement 11, and the operation thereof, is conventional and well understood. Further description of such arrangement is believed unnecessary.

Referencing now the present invention, there is provided a current-transfer head assembly 41 which mounts on the shaft portion 23 exteriorly of the tank for permitting transfer of high-amperage electrical current to the shaft 23 and thence to the support roll. This current transfer head assembly 41 is mounted on the axially stepped outwardly projecting shaft portion 23 which projects beyond one of the tank side walls 14.

Figure 3:
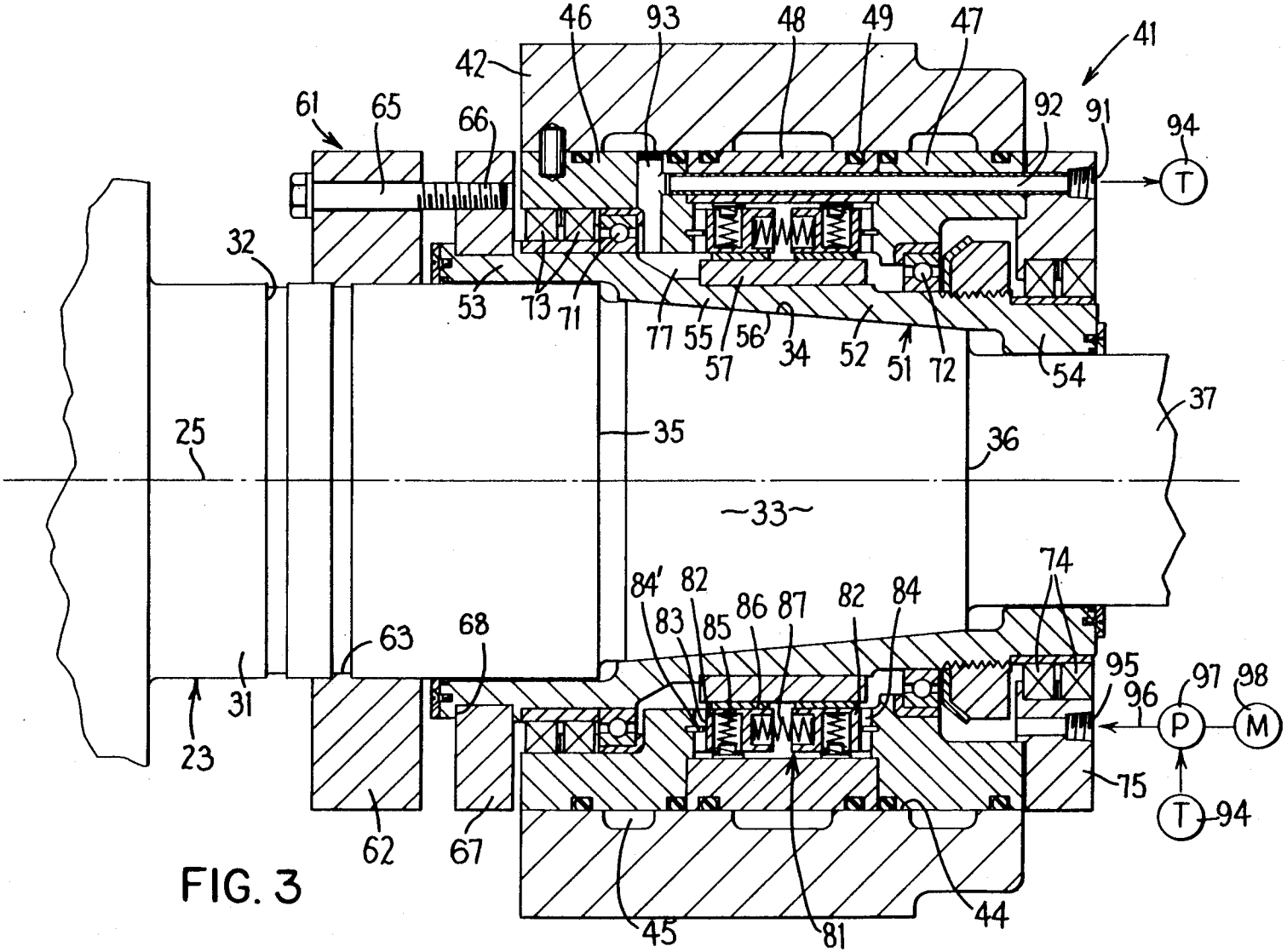
FIG. 3 is an enlarged fragmentary sectional view showing one projecting stepped end of the roll shaft having an improved current collector of this invention mounted thereon.

More specifically, and as illustrated by FIG. 3, this axially stepped shaft portion 23, exteriorly of the tank side wall, has a generally cylindrical shaft portion 31 of substantially uniform outer diameter, which shaft portion 31 has one or more undercut annular grooves 32 formed therearound. This shaft portion 31 is integrally and fixedly joined to a coaxially adjacent shaft portion 33 which, in its entirety, is of smaller diameter than the shaft portion 31. In fact, shaft portion 33 is of a tapered or truncated conical configuration having an outer cylindrical periphery 34 which is of progressively decreasing diameter as this shaft portion 33 projects axially away from the shaft portion 31. Shaft portion 31, where it interfaces with the shaft portion 33, defines an annular shoulder 35. A further such annular shoulder 36 is formed at the outer end of the truncated conical shaft portion 33, which latter shaft portion 33 is fixedly and integrally coaxially joined to an adjacent cylindrical shaft portion 37, the latter being of smaller but generally uniform diameter. The taper or slope of the surface 34, relative to the axis 25, is rather small and typically in the range of about 3° to about 10°.

Figure 4:
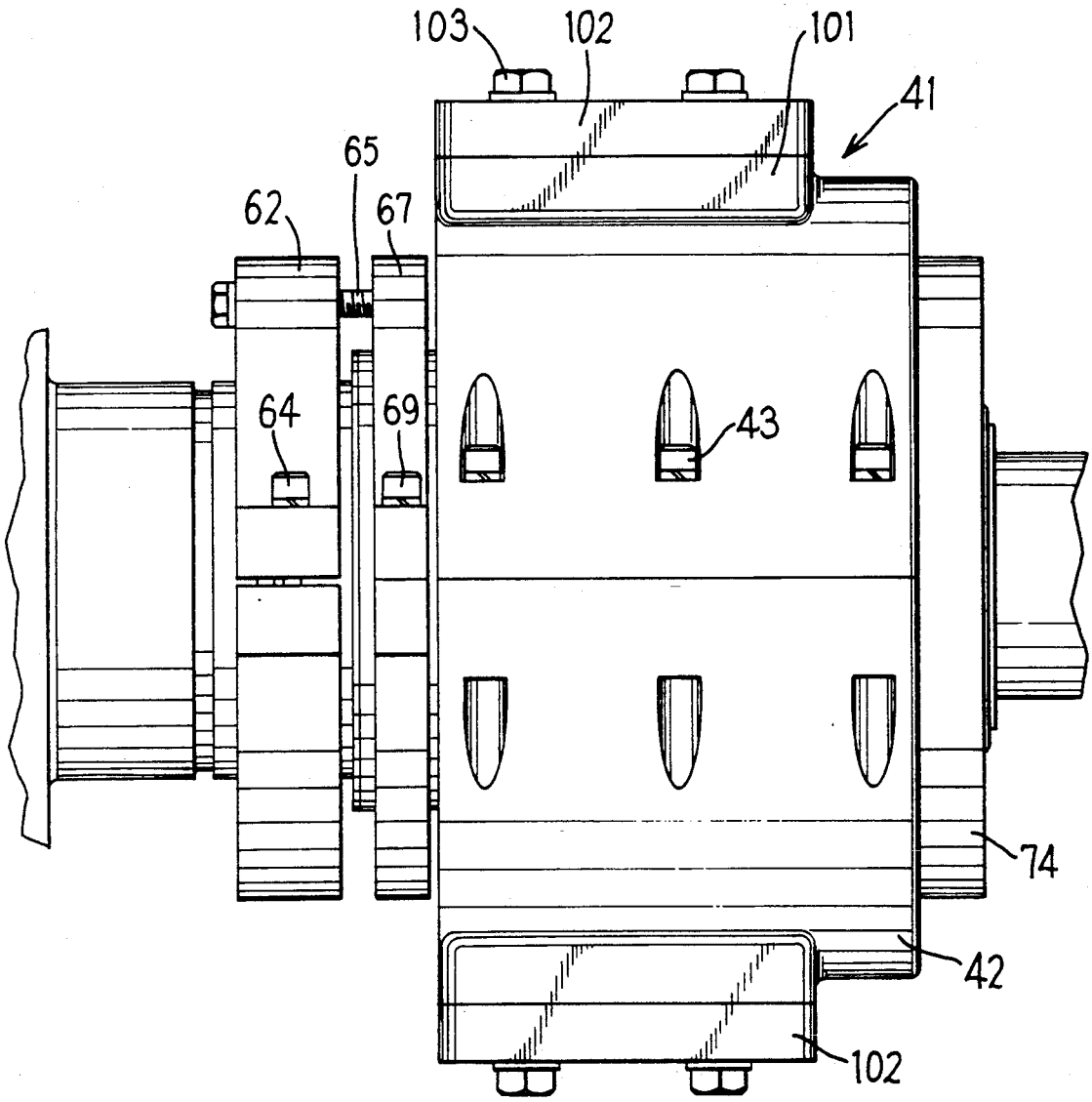
FIG. 4 is a nonsectional elevational view corresponding to FIG. 3.

Considering now the structure of the current transfer head assembly 41 (FIGS. 3–5), this assembly includes a sleevelike outer housing 42 which is preferably diametrically split into opposed halves which are fixedly secured together by conventional fasteners 43 such as screws or the like. This housing 42 has a generally cylindrical bore 44 extending coaxially therethrough, and a plurality of undercut grooves or passages 45 open outwardly from the cylindrical bore and extend at least partially therearound for defining coolant passages.

Housing 42 surrounds and is nonrotatably secured to an interior electrically-conductive ring structure which, as illustrated by FIG. 3, is preferably formed by three coaxially aligned conductive ring members 46, 47 and 48. These ring members 46–48 are normally constructed of copper alloy, and the ring members 46 and 47 are disposed adjacent axially opposite ends of the housing 42 with the remaining ring member 48 being axially sandwiched therebetween. Each ring member has a pair of axially spaced grooves in which are confined conventional elastomeric seal rings 49, the latter straddling each of the coolant passages 45 to maintain a sealed relationship.

The current transfer head assembly 41 also includes a sleeve or cartridge arrangement 51 which is axially and nonrotatably attached to the stepped shaft portion 23. This sleeve arrangement includes an axially elongate one-piece sleeve member 52 having a larger-diameter sleeve portion 53 at one end thereof disposed for close surrounding relationship to the cylindrical shaft portion 31, and a further smaller-diameter sleeve portion 54 at the other end thereof disposed for close surrounding engagement with the small-diameter shaft portion 37. These sleeve portions 53 and 54 are in turn joined by an intermediate sleeve portion 55 which defines therein an axially elongate interior cylindrical wall 56 of a tapered or truncated conical configuration. This conical wall 56 has a taper which substantially corresponds to that of the conical shaft portion 33 so that the opposed conical walls 56 and 34 can be positioned in snug and relatively nonmovable contact with one another.

The sleeve arrangement 51 also includes an electrically conductive sleeve or ring member 57 which is fixedly secured to the center sleeve portion 55 in external surrounding relationship thereto. This conductive ring 57 is normally constructed of a highly electrically-conductive material, such as copper alloy, and is provided with a smooth exterior cylindrical surface.

The sleeve arrangement 51 is axially secured relative to the shaft portion 23 by a securing arrangement 61 which includes a ring-shaped securing collar 62 having an interior annular rib 63 which projects radially into one of the shaft grooves 32. This collar 62 is normally diametrically split into substantially equal halves, with the halves being fixedly joined together by securing elements or fasteners such as conventional screws 64. This clamping collar 62 mounts thereon a plurality of axial drawing elements 65, such as threaded screws or bolts, the latter being threadedly engaged at 66 to a further ring-shaped collar 67 which is disposed axially adjacent but slightly axially spaced from the clamping collar 62. This collar 67, which functions as a "drawing" collar for permitting drawing or pulling of the sleeve arrangement 51 onto the shaft portion 23, is disposed so as to abut against an axial shoulder 68 formed on the inner end of the sleeve member 52, with this drawing collar 67 normally being diametrically split into substantially uniform opposed halves, the latter being typically secured together by threaded fasteners such as screws 69. By effecting rotation of the drawing elements 65, coupled with the threaded engagement 66 thereof with the drawing collar 67, this hence can be utilized to effect axial drawing movement (leftwardly in FIG. 3) of the sleeve arrangement 51 so as to effect a snug and in fact a substantially interference fit between the opposed tapered surfaces 34 and 56. This both axially and circumferentially fixes the sleeve arrangement 51 to the shaft portion 33 and ensures an efficient electrically conductive path therebetween.

Figure 5:
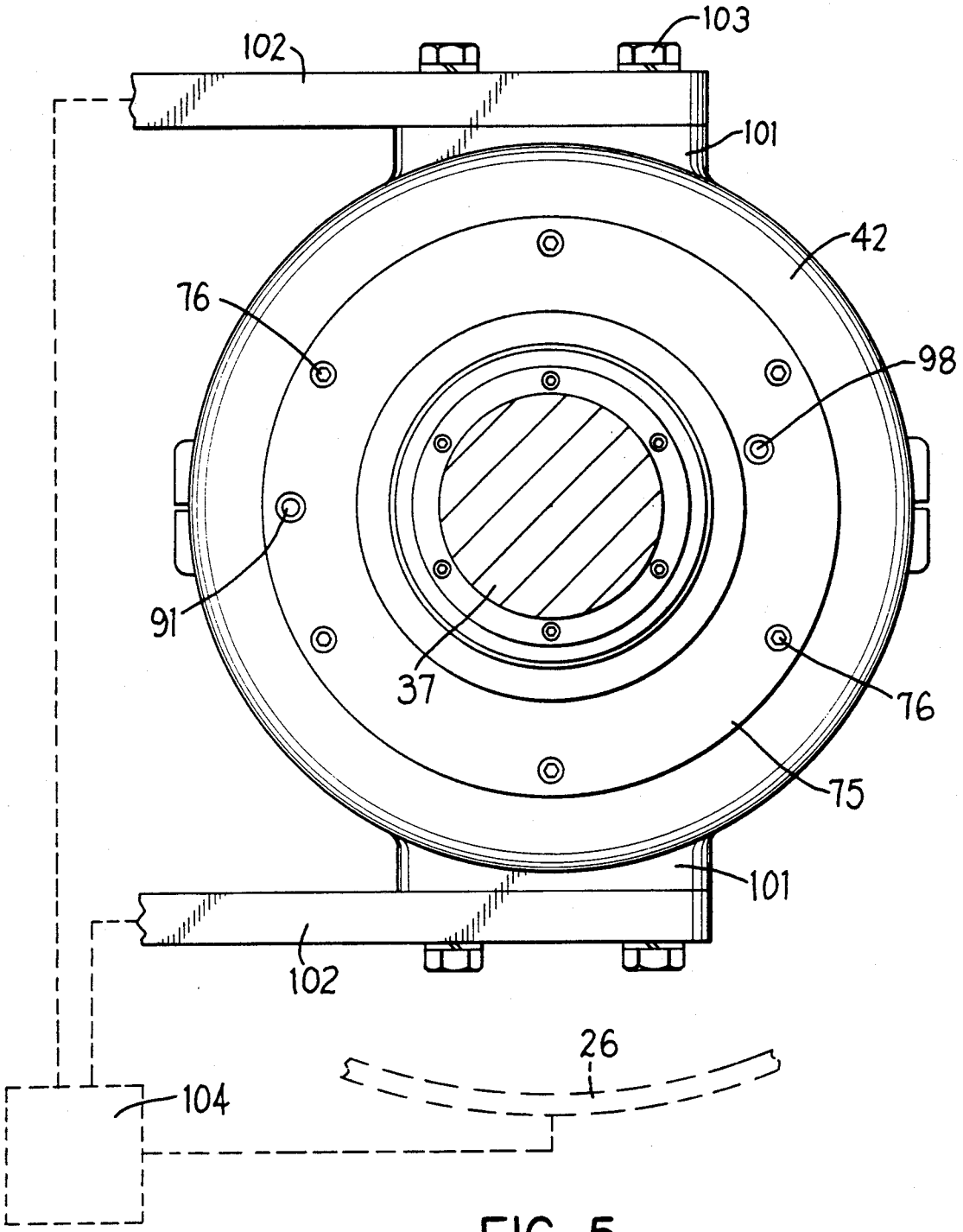
FIG. 5 is an end elevational view taken from the right side of FIG. 4.

The sleeve arrangement 51 projects coaxially through the ring arrangement 46–48, and in fact a pair of conventional anti-friction bearings 71 and 72 are seated on the sleeve member 52 adjacent opposite ends thereof and are respectively maintained in engagement with and surrounded by the respective ring members 46 and 47. These bearings 71 and 72 permit the housing 42, the copper ring members 46–48, and other elements carried thereby, to be concentrically but freely rotatably supported in surrounding relationship to the sleeve arrangement 51. A pair of conventional annular seal members 73 are disposed adjacent but outwardly of the bearing 71, with these seal members 73 being slightly axially spaced and hence creating a series arrangement to ensure proper sealing at the inner or inboard end of the head assembly. In similar fashion, a further pair of adjacent but slightly axially spaced annular seals 74 are disposed outwardly of the bearing 72 at the outer or outboard end of the head assembly. These seals 74 sealingly cooperate with a surrounding ring-shaped end cap 75 which is disposed directly adjacent and is fixedly secured to the ring 47, such as by screws or fasteners 76 (FIG. 5). These end seals 73 and 74 result in an annular chamber 77 as defined between the ring arrangement 46–48 and the sleeve arrangement 51 being effectively sealed at opposite ends thereof. This chamber 77, and the sealing closure thereof, permits proper forced circulation of a liquid lubricant therethrough as explained below.

To permit conduction of electrical current between the relatively rotatable components, the ring arrangement 46–48 nonrotatably mounts therein a plurality of circumferentially spaced contact arrangements 81 which are nonrotatably secured interiorly of the center ring 48 and maintained in slidable engagement with the exterior of the sleeve ring 57. Each contact arrangement 81 includes an axially opposed pair of blocklike shoes 82 which are constructed of a highly electrically conductive material, such as copper alloy. Each shoe 82 has a radially projecting groove 83 formed in the outer axial end thereof, and into this groove 83 projects a key 84 which is fixed to the axially adjacent ring member 46 or 47 by a pin 84'. Each conductive shoe 82 is urged radially inwardly toward the ring member 57, and for this purpose the shoe has a radially outwardly opening recess in which is confined a small compression spring 85, one end of which bears against the inner blind end of the recess, and the other end of which carries a button which is urged against an inner peripheral wall of the center ring 48. The axially opposed pair of conductive shoes 82 also have opposed recesses which confine opposite ends of a further compression spring 87, which latter spring 87 axially urges the shoes apart to maintain each in direct but radially slidable contact with the respectively adjacent ring 46 and 47.

Each shoe 82 also has a highly electrically conductive contact element 86 secured to the inner periphery thereof, this element 86 having an arcuate contour corresponding to the outer diameter of the ring 57 and extending through a small arcuate extent so as to create an intimate but relatively rotatable sliding engagement between the contact member 86 and the conductive ring 57. This contact member 86 is normally constructed of silver.

The conductive shoes 82 and their associated contacts 86 are all effectively disposed within the interior annular chamber 77, and in fact the conductive walls of the ring 57 and of the rings 46 and 47, which walls have slidable engagement with the shoes 82 or the contacts 86, also function as boundary walls for this chamber 77 so as to permit intimate contact with the lubricant which is circulated through the chamber 77.

The current transfer head assembly 41 also incorporates as a operational part thereof a fluid pressure system for permitting substantially continuous circulation of a liquid lubricant into and through the chamber 77. For this purpose, the assembly 41 has a fluid outlet port 91 which projects axially into the end plate 75 on the upper portion thereof. The port 91 is aligned with and communicates with an elongate passage 92 which extends generally axially through the rings 47 and 48 so as to terminate in the ring 46, at which point passage 92 communicates with a further passage 93 which is formed radially through the ring 46. The radially outer end of this passage 93 is plugged, and the inner end communicates directly with the annular chamber 77 in close proximity to the inboard bearing 71. The outlet or discharge port 91 is coupled through a suitable conduit with the tank or reservoir 94. The chamber 77 also communicates with an inlet or supply port 95 which extends axially through the lower portion of end plate 75. This supply port 98 communicates directly with the outboard end of the chamber 77, this being the opposite end of the chamber from the passage 93. Port 95 is coupled to a conduit which connects to the discharge of a conventional pump 97 as driven by a motor 98, which pump receives or sucks fluid from the tank or reservoir 94 for pressurizing it and supplying it into the chamber 77. Hence, lubricant (i.e. oil) supplied to the chamber 77 flows axially from one end to the other to effect desired lubricating during typical circulation of lubricating oil through the chamber 77. The lubricant oil supplied to the chamber 77 also, as a secondary effect, is beneficial in the cooling the current transfer head assembly.

To permit supply of electric current to the head assembly 41, the housing 42 has a pair of bosses or pads 101 formed on substantially diametrically opposite sides thereof, which pads permit conductive elements 102 such as laminated copper plates or straps to be secured thereto, such as by screws 103. These plates or straps 102 are connected to a source 104 of direct current potential, which source is also connected to the anode 26. The straps 102 additionally function to hold the housing 42 and the associated structure thereof in a nonrotatable condition.

In operation, the roll 17 is rotatably driven in a conventional manner so as to cause the sheet W to be moved through the electrolytic bath. This causes corresponding rotation of the tapered shaft portion 23 and rotation of the sleeve or cartridge 51 associated with the head assembly 41. The remainder of the assembly 41 remains stationary due to its being coupled to the current-conducting straps 102. These straps 102 supply high-amperage electric current to the housing 42 and thence into the ring structure 46-48. These in turn transfer the current to the conductive shoes 82 and thence through the silver contacts 86 to the cartridge assembly 51. Due to the continuous circulation of lubricating oil through the chamber 77, which oil is supplied adjacent the outboard end and exits adjacent the inboard end of the chamber, substantially high current levels can be efficiently and continuously transmitted through a small number of currenttransmitting shoes without experiencing excessive friction or wear, and without overheating. This lubricant facilitates the continual relative sliding movement between the rotating conductive ring 57 and the nonrotating silver contacts 86. Since chamber 77 is sealed and in fact is generally internally pressurized due to the lubricant being supplied continuously therethrough, this also substantially prevents the hostile surrounding environment including both vapors and liquids from effectively gaining access into the chamber 77.

In the current transfer head assembly 41 of the present invention, there is typically provided a small number of axially-opposed pairs of conductive shoes 82 disposed in angularly spaced relationship around the head assembly. For example, the head assembly typically will incorporate in the range of about 6 to 8 axiallyopposed pairs of conductive shoes 82 disposed in circumferentially spaced relationship around the head assembly.

The provision of a tapered sleeve similar to the sleeve 51 illustrated in FIG. 3, and the securement of the sleeve to the tapered shaft by a securing arrangement corresponding to the arrangement 61 also illustrated by FIG. 3, is conventional and has been used for mounting of conventional current collectors prior to the present invention.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an electroplating apparatus including a tank for containing a bath of an electroplating solution, a roll supported on side walls of the tank for rotation about a substantially horizontal axis so that a significant portion of the roll is immersed in the bath, said roll having an electrically conductive member fixed to and extending circumferentially therearound adjacent the periphery thereof, an anode member stationarily positioned within said tank adjacent said roll, a shaft coaxially fixed to said roll and projecting generally horizontally outwardly for disposition exteriorly of the tank, and an electrical current transfer head assembly mounted on said shaft exteriorly of the tank for transmitting electrical current from an external source to the shaft, said shaft including an axially elongated shaft portion of truncated conical configuration, said shaft portion being of progressively increasing diameter as the shaft portion projects axially toward the tank, said head assembly including a sleeve arrangement disposed in nonrotatable surrounding relationship to said shaft, said sleeve arrangement having a truncated conical sleeve portion which is directly snugly engaged with the truncated conical shaft portion, the improvement comprising:

said head assembly including a generally cylindrical sleevelike housing arrangement disposed in surrounding and relatively rotatable relationship with respect to said sleeve arrangement, said housing arrangement cooperating with said sleeve arrangement for defining an axially elongate chamber therebetween;

a pair of axially-spaced end seal means cooperating between said housing arrangement and sleeve arrangement for sealingly closing opposite axial ends of said chamber;

a contact ring fixedly secured to and externally surrounding said conical sleeve portion and defining thereon a generally cylindrical exterior contact surface, said contact ring being disposed axially between said pair o end seal means, and said contact ring being constructed of a highly electrically conductive material;

a plurality of electrically conductive contact assemblies nonrotatably but radially flatably mounted on said housing arrangement and having contact surfaces which are resiliently urged radially inwardly for slidable contact and current transfer engagement with the exterior contact surface of said contact ring; and fluid lubricant supply means including supply passages formed in said housing arrangement and communicating with said chamber adjacent opposite axial ends thereof for permitting substantially continuous circulation of lubricating oil into and through said chamber.

2. An apparatus according to claim 1, wherein said housing arrangement includes an electrically conductive outer housing sleeve having a plurality of conductive rings disposed concentrically therein, said rings being stationarily fixed relative to the housing sleeve and fixedly related in axially adjacent relationship to one another, and said electrically conductive contact assemblies being nonrotatably positioned interiorly of one of said rings and spring urged inwardly for slidable engagement with said contact ring.

3. An apparatus according to claim 2, wherein the plurality of contact assemblies are disposed circumferentially around the housing arrangement and each includes a pair of blocklike shoes constructed of an electrically conductive material and disposed in axially adjacent relationship, the axially-adjacent pair of shoes of each contact assembly being supported for slidable movement radially relative to the housing arrangement and being disposed in radial sliding contact with one of the conductive rings, first spring means associated with each contact assembly for normally resiliently urging the respective pair of shoes in axially opposite directions for maintaining a secure but slidable contact with the housing structure, the contact assembly also including separate spring means for normally resiliently urging both shoes radially inwardly for secure but slidable contact with the periphery of the contact ring, each said shoe having an arcuate contact plate fixed thereto and disposed in slidable contact with the contact ring, said contact plate being constructed of silver.

4. In an electroplating apparatus including a tank for containing a bath of an electroplating solution, a roll supported on side walls of the tank for rotation about a substantially horizontal axis so that at least a portion of the roll is immersed in the bath, said roll having an electrically conductive member fixed to the periphery thereof, an anode member stationarily positioned within the bath in close proximity to the roll, the roll having a shaft coaxially fixed thereto and projecting generally horizontally outwardly for disposition exteriorly of the tank, and an electrical current transfer head assembly mounted on the shaft exteriorly of the tank for transmitting electrical current from an external source to the shaft, the shaft having exteriorly of the tank an axially elongated shaft part of generally truncated conical configuration, and the head assembly including a sleeve member disposed in nonrotatable surrounding relationship to the shaft and having a truncated conical sleeve portion which is snugly engaged with the truncated conical shaft part, the improvement wherein said current transfer head assembly comprises:

a generally cylindrical sleevelike housing arrangement disposed in surrounding and relatively rotatable relationship with respect to said sleeve member, said housing arrangement cooperating with said sleeve member for defining an axially elongate chamber therebetween;

a pair of end seal means cooperating between said housing arrangement and said sleeve member for sealingly closing opposite axial ends of said chamber;

a plurality of electrically conductive contact assemblies nonrotatably but radially floatably mounted on said housing arrangement in circumferentially spaced relationship therearound and having contact surfaces which are resiliently urged radially inwardly for slidable contact and current transfer engagement with an exterior contact surface of said sleeve member;

each said contact assembly including a pair of blocklike contact shoes constructed of a highly electrically conductive material and disposed in axially adjacent relationship, each shoe and the housing arrangement having opposed radially-directed contact surfaces which permit current transfer from said housing arrangement to said shoe while permitting the shoe to radially slide relative to the housing, and spring means cooperating with the shoes for both urging the shoes axially for maintaining proper contact between the opposed contact surfaces and for continually urging the shoes radially inwardly for sliding contact with the contact surfaces on the sleeve member; and fluid lubricant means contained in said chamber.

5. An apparatus according to claim 4, wherein the housing arrangement includes an electrically conductive outer housing sleeve having three axially adjacent electrically conductive inner rings fixedly and concentrically disposed therein, said inner rings including a pair of end rings having a middle ring sandwiched therebetween, said contact assemblies being positioned within said inner ring so that the pair of blocks associated with each assembly are spring urged axially away from one another and having respective contact surfaces thereof disposed in radial sliding engagement with opposed contact surfaces on the respective end rings, and further springs cooperating between said contact blocks and said middle ring for urging the contact blocks radially inwardly for sliding contact with the contact surface of the sleeve member.

6. An arrangement according to claim 4, including electrically-conductive flexible straps connected to said housing arrangement for maintaining said housing arrangement nonrotatable and for permitting transfer of electrical current thereto.

7. An arrangement according to claim 4, wherein each said end seal means includes a pair of separate seal members cooperating between said housing arrangement and said sleeve member at the respective axial end of the chamber, said pair of seal members being disposed generally in series with one another.

8. An arrangement according to claim 4, including fluid lubricant supply means connected to said chamber for permitting substantially continuous circulation of lubricating oil into and through said chamber, said supply means including an inlet port coupled to an axially lower portion of said chamber at one axial end thereof, and an outlet port communicating with an upper portion of said chamber adjacent the other axial end thereof.

9. An apparatus according to claim 1, including electrically-conductive flexible straps connected to said sleevelike housing arrangement for maintaining said housing arrangement nonrotatable and for permitting transfer of electrical current thereto.

10. An apparatus according to claim 1, wherein said end seal means cooperates directly between said sleevelike housing arrangement and said sleeve arrangement, and a pair of anti-friction bearings positioned within said chamber in respectively axially adjacent relationship to said pair of end seal means, said anti-friction bearings being spaced outwardly from opposite axial ends of said contact ring and cooperating directly between said sleevelike housing arrangement and said sleeve arrangement.

11. An apparatus according to claim 10, including electrically-conductive flexible straps connected to said sleevelike housing arrangement for maintaining said housing arrangement nonrotatable and for permitting transfer of electrical current thereto.

12. An arrangement according to claim 6, including a contact ring fixedly secured to and externally surrounding said sleeve member and defining thereon a generally cylindrical exterior surface which defines said exterior contact surface for engagement with the contact assemblies, said contact ring being disposed axially between and axially spaced from said pair of end seal means and constructed of a highly electrically-conductive material.

13. An arrangement according to claim 12, including a pair of bearings cooperating directly between said sleeve member and said housing arrangement adjacent opposite axial ends of said chamber, said bearings being disposed axially adjacent but disposed axially inwardly from the respective end seal means, and said contact ring being disposed axially between said bearings.

* * * * *

UNITED STATES PATENT AND TRADEMARK OFFICE

CERTIFICATE OF CORRECTION

PATENT NO. : 5 164 059

DATED : November 17, 1992

INVENTOR(S) : Thomas J. GEIERMANN et al

It is certified that error appears in the above-identified patent and that said Letters Patent is hereby corrected as shown below:

Column 9, line 29; change "o" to ---of---.

Column 9, line 33; change "flatably" to ---floatably---.

Signed and Sealed this

Twenty-third Day of November, 1993

*Attest:*

Bruce Lehman

BRUCE LEHMAN

*Attesting Officer*

*Commissioner of Patents and Trademarks*